US012228128B2

(12) United States Patent
Yang et al.

(10) Patent No.: US 12,228,128 B2
(45) Date of Patent: Feb. 18, 2025

(54) COMPRESSOR AND MOVING SCROLL THEREOF

(71) Applicant: Robert Bosch GmbH, Stuttgart (DE)

(72) Inventors: Devin Yang, Shanghai (CN); Xiaofeng Gu, Shanghai (CN); Haixiang Wang, Shanghai (CN)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/353,481

(22) Filed: Jul. 17, 2023

(65) Prior Publication Data

US 2024/0026883 A1 Jan. 25, 2024

(30) Foreign Application Priority Data

Jul. 19, 2022 (CN) ..... 202210847350.6

(51) Int. Cl.
*F04C 18/02* (2006.01)

(52) U.S. Cl.
CPC ..... *F04C 18/0215* (2013.01); *F04C 2240/30* (2013.01)

(58) Field of Classification Search
CPC ..... F04C 18/0215; F04C 2240/30; F04C 18/0292; F04C 18/0246; F04C 29/12; F04C 2210/26; F04C 2240/10; F04C 2240/20; F04C 2240/50; F04C 2240/60; F05B 2210/14; F05B 2240/10; F05B 2240/20; F05B 2240/50; F05B 2240/60
See application file for complete search history.

(56) References Cited

U.S. PATENT DOCUMENTS

2011/0243777 A1* 10/2011 Ito ..... F04C 29/0021 418/55.2

FOREIGN PATENT DOCUMENTS

| | | | |
|---|---|---|---|
| EP | 2369182 | A1 | 9/2011 |
| WO | 2005010372 | A1 | 2/2005 |
| WO | 2015085823 | A1 | 6/2015 |

* cited by examiner

*Primary Examiner* — J. Todd Newton
(74) *Attorney, Agent, or Firm* — Michael Best & Friedrich LLP

(57) ABSTRACT

A compressor and a moving scroll thereof includes a moving scroll wall integrally formed at a first side of a moving base plate, the moving scroll wall extending around an axis. A collection groove is disposed on an end face of the moving scroll wall, the end face being located at the end of the moving scroll wall that is opposite the moving base plate in the direction of the axis. A channel running in the direction of the axis is disposed between the collection groove and a second side, the channel and the collection groove being connected at a first port, and the channel running through the second side at a second port. The collection groove extends not less than 60 degrees and not more than 400 degrees around the axis from the first port to the collection end.

17 Claims, 5 Drawing Sheets

COMPRESSOR AND MOVING SCROLL THEREOF

BACKGROUND

The present application relates to a compressor for pressurizing a fluid, in particular to a scroll compressor for pressurizing a refrigerant.

A scroll compressor contains a moving scroll and a static scroll; the working moving scroll is driven by an eccentric shaft to revolve relative to the fixed static scroll without spinning, thereby forming a compression chamber for compressed fluid between the moving scroll and the static scroll. A backpressure chamber is provided at the side of the moving scroll that is opposite the static scroll. The pressure of the compression chamber applies a compression thrust to the moving scroll, and the pressure of the backpressure chamber applies a backpressure thrust to the moving scroll. During compressor operation, the pressure of the compression chamber and the pressure of the backpressure chamber are separately dynamically changing. When the sizes of the compression thrust and the backpressure thrust differ, a thrust imbalance arises. For example, when the compression thrust is greater than the backpressure thrust, an extremity of the moving scroll will break contact with the static scroll and leak compressed fluid. Thus, the working efficiency of the compressor will fall. As another example, when the compression thrust is less than the backpressure thrust, the moving scroll will be pushed by the backpressure thrust such that the extremity of the moving scroll tightly abuts the static scroll, and when the compression thrust is much less than the backpressure thrust, friction between the moving scroll and the static scroll will be too high. The working efficiency of the compressor will also fall.

SUMMARY

The present application mainly solves the technical problem in the prior art that a moving scroll of a compressor struggles to achieve efficient compression.

To solve the above technical problem, the present application provides a moving scroll, comprising:

a moving base plate, provided with a shaft seat with an axis as its shaft center, the moving base plate comprising a first side and a second side which are opposite each other in the direction of the axis, the shaft seat being disposed at the second side;

a moving scroll wall, integrally formed at the first side of the moving base plate, the moving scroll wall extending around the axis from a position near the axis in a direction away from the axis, the moving scroll wall having an end face, the end face being located at the end of the moving scroll wall that is opposite the moving base plate in the direction of the axis, and a collection groove being disposed on the end face;

a channel running in the direction of the axis is disposed between the collection groove and the second side, the channel and the collection groove being connected at a first port, the channel running through the second side at a second port, the collection groove extending from the first port to a collection end in a direction towards the center of the moving scroll, and the collection groove extending not less than 60 degrees and not more than 400 degrees around the axis from the first port to the collection end.

In some particular embodiments, the diameter of the channel is not less than 0.2 times the thickness of the moving scroll wall and not more than 0.9 times the thickness of the moving scroll wall, the width of the collection groove is not more than 0.9 times the thickness of the moving scroll wall, and the collection groove extends not less than 90 degrees and not more than 365 degrees around the axis from the first port to the collection end.

In some particular embodiments, the diameter of the channel is not less than 0.3 times the thickness of the moving scroll wall and not more than 0.7 times the thickness of the moving scroll wall, the collection groove comprises a bottom groove and a sealing part, the bottom groove being closer to the moving base plate than the sealing part, the width of the bottom groove being not more than 0.3 times the thickness of the moving scroll wall, the width of the sealing part being greater than the width of the bottom groove, and a sealing member is installed in the sealing part, the sealing member extending towards the collection end from above the first port but not sealing the collection end, the sealing member preventing fluid from entering the bottom groove and the channel in the direction of the axis, and the length of the sealing member in the circumferential direction of the moving scroll being not less than 0.3 times the total length of the collection groove.

In some particular embodiments, the width of the sealing part is greater than that of the bottom groove such that a step is formed between the sealing part and the bottom groove, the sealing member is supported on the step, the collection groove extends not less than 110 degrees and not more than 300 degrees around the axis from the first port to the collection end, and the length of the sealing member in the circumferential direction of the moving scroll is not less than 0.6 times the total length of the collection groove.

In some particular embodiments, the length of extension of the collection groove around the axis from the first port to the collection end is not less than 15 mm, and the outer diameter of the moving scroll is not greater than 120 mm.

In some particular embodiments, the second port is located at a surface at one end, in the direction of the axis, of a peripheral wall of the shaft seat, or located at a relatively protruding region at an outer side of the peripheral wall of the shaft seat, a throttle hole running in the direction of the axis is disposed between the first side and the second side, the radial distance from the throttle hole to the axis being not less than 0.3 times the radius of the moving scroll, and the diameter of the throttle hole being less than 0.3 times the diameter of the channel.

In some particular embodiments, the collection end is processed into a circular shape, the diameter of the collection end is greater than the width of the collection groove, the width of the collection groove is not greater than 3 mm, and the depth of the collection groove is greater than 0.2 mm and less than 3 mm.

In another aspect, the present application provides a compressor, comprising:

a housing, defining an accommodating cavity;

a static scroll fixed in the accommodating cavity, the static scroll comprising a static base plate and a static scroll wall, the static base plate and the static scroll wall being integrally formed;

a middle plate, the middle plate being fixed in the accommodating cavity;

a main shaft, rotatable relative to the housing around a main axis, the main shaft being provided with an eccentric shaft; and the moving scroll described above, the moving scroll being mounted between the static scroll and the middle plate, the eccentric shaft being mounted in the shaft seat, the shaft center of the eccentric shaft coinciding with the axis, the axis being located on a parallel line offset from the main axis, a side face of the moving scroll wall meshing with a side face of the static scroll wall, the end face of the moving scroll wall being in sliding contact with the static base plate, a compression chamber being formed between the moving scroll and the static scroll, a backpressure chamber being formed between the middle plate and the second side, and the second port being located in the backpressure chamber.

In some particular embodiments, the moving scroll is movable between a first position and a second position in an axial direction, between the static scroll and the middle plate; at the first position, the end face is in tight contact with the static scroll; at the second position, the end face leaves the static scroll; at the first position, the collection groove is isolated from the compression chamber; and at the second position, the collection groove is connected to the compression chamber.

In some particular embodiments, a suction chamber is formed between the housing and the side of the middle plate that is opposite the backpressure chamber, a main bearing is mounted on the middle plate, the main bearing supports the main shaft, a rolling bearing is mounted in the shaft seat, and the second port is located in the shaft seat.

According to the technical solution of the present application, the collection groove extends not less than 60 degrees and not more than 400 degrees around the axis from the first port to the collection end, the collection end and the collection groove forming a fluid inlet for compensation of backpressure; the inlet is substantially larger than in the prior art, so can easily achieve good backpressure compensation.

BRIEF DESCRIPTION OF THE DRAWINGS

Particular embodiments of the present application are explained in detail below with reference to the drawings, wherein.

DETAILED DESCRIPTION

Figure 1:
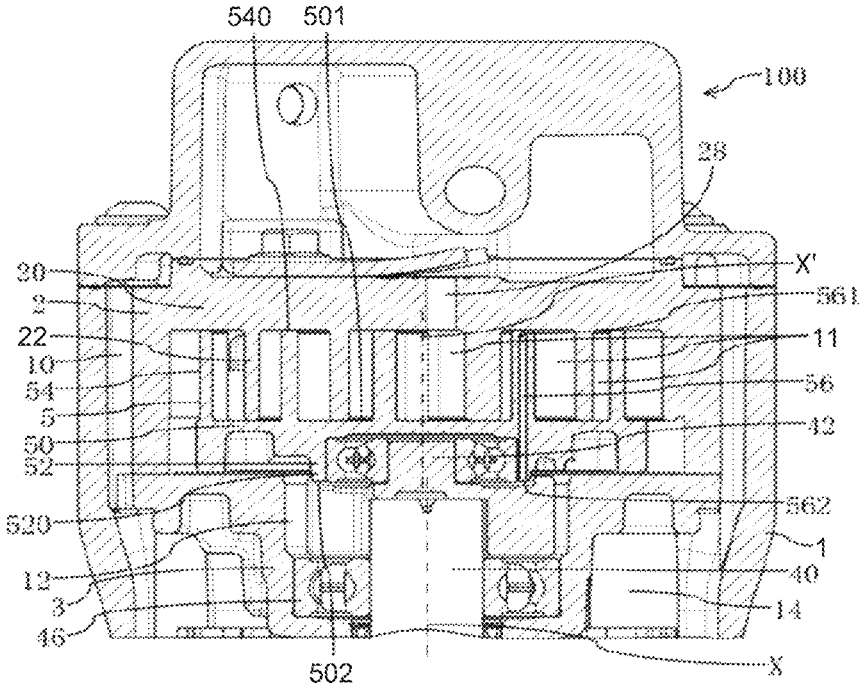
FIG. 1 shows a schematic drawing of a compressor in a particular embodiment.

Referring to FIG. 1, a compressor 100 according to a particular embodiment of the present application comprises a housing 1, a static scroll 2, a middle plate 3, a main shaft 40 and a moving scroll 5. The housing 1 defines an accommodating cavity 10. The static scroll 2 and the middle plate 3 are separately fixed in the accommodating cavity 10. The static scroll 2 comprises a static base plate 20 and a static scroll wall 22. The static base plate 20 and the static scroll wall 22 are integrally formed. A discharge port 28 is disposed running through the center of the static base plate 20.

The moving scroll 5 is mounted between the static scroll 2 and the middle plate 3. Referring to FIGS. 2 and 6-8, the moving scroll 5 comprises a moving base plate 50 and a moving scroll wall 54. The moving scroll wall 54 and the moving base plate 50 are integrally formed. The moving base plate 50 is provided with a shaft seat 52 with an axis X' as its shaft center. The moving base plate 50 comprises a first side 501 and a second side 502, which are opposite each other in the direction of the axis X'. The moving scroll wall 54 is located at the first side 501 of the moving base plate 50. The shaft seat 52 is disposed at the second side 502. The moving scroll wall 54 extends around the axis X' from a position near the axis X' in a direction away from the axis X'. That is to say, counted from the position near the axis X', the greater the angle of extension of the moving scroll wall 54 around the axis X', the greater the distance between the axis X' and the position to which the moving scroll wall extends. In other words, the moving scroll wall 54 extends around the axis X' in such a way that it gradually moves away from the axis X'.

The moving scroll wall 54 has an end face 540 and a side face (not labelled). The end face 540 is located at the end of the moving scroll wall 54 that is opposite the moving base plate 50 in the direction of the axis X'. The side face of the moving scroll wall 54 is substantially parallel to the direction of the axis X'. The side face of the moving scroll wall 54 meshes with a side face of the static scroll wall. The end face 540 of the moving scroll wall 54 is in sliding contact with the static base plate A compression chamber 11 is formed between the moving scroll 5 and the static scroll 2. A backpressure chamber 12 is formed between the middle plate 3 and the second side 502. A second port 562 is located in the backpressure chamber 12.

A collection groove 542 is disposed on the end face 540. A channel 56 running in the direction of the axis X' is disposed between the collection groove 542 and the second side 502. The channel 56 and the collection groove 542 are connected at a first port 561, and the channel 56 runs through the second side 502 at the second port 562. The collection groove 542 extends from the first port 561 to a collection end 544, in a direction towards the center of the moving scroll 5. That is, in the direction from the first port 561 to the collection end 544, the collection groove 542 extends in the circumferential direction of the moving scroll 5, gradually approaching the center.

A main bearing 46 is mounted on the middle plate 3, the main bearing 46 supporting a main shaft 40. The main shaft 40 is rotatable around a main axis X relative to the housing 1. The main shaft 40 is provided with an eccentric shaft 42. The eccentric shaft 42 is mounted in the shaft seat 52. For example, a rolling bearing is mounted in the shaft seat 52, and the eccentric shaft 42 is mounted in the rolling bearing. The shaft center of the eccentric shaft 42 and the shaft center of the shaft seat 52 coincide at the axis X'. The axis X' is located on a parallel line offset from the main axis X. As the main shaft 40 rotates, the eccentric shaft 42 revolves around the main axis X, and spins in the shaft seat 52 around the axis X' relative to the moving scroll wall 54.

A suction chamber 14 is formed between the housing 1 and the side of the middle plate 3 that is opposite the backpressure chamber 12. The suction chamber 14 is in communication with a space lying at the periphery of the moving scroll 5 and the static scroll 2. As the main shaft 40 rotates, the eccentric shaft 42 drives the moving scroll 5 to operate relative to the static scroll 2, and fluid is sucked from the periphery of the moving scroll 5 and the static scroll 2 into the compression chamber between the moving scroll 5 and the static scroll 2; during operation, the compression chamber moves in a direction from the periphery towards the center and its volume gradually decreases, the fluid in the compression chamber is gradually pressurized, and high-pressure fluid is finally discharged from the discharge port 28 at the center of the moving scroll 5 and the static scroll 2. This cycle is repeated to achieve continuous scroll compression. Clearly, the pressure of fluid in the compression chamber changes dynamically; moreover, the pressure of fluid in the compression chamber gradually increases from the periphery towards the center.

To facilitate explanation, in the present application, the direction of the axis X' is taken to be the vertical direction. Taking the moving scroll 5 as a reference, the moving scroll wall 54 is above the moving base plate 50, and the moving base plate 50 is below the moving scroll wall 54.

Figure 9:
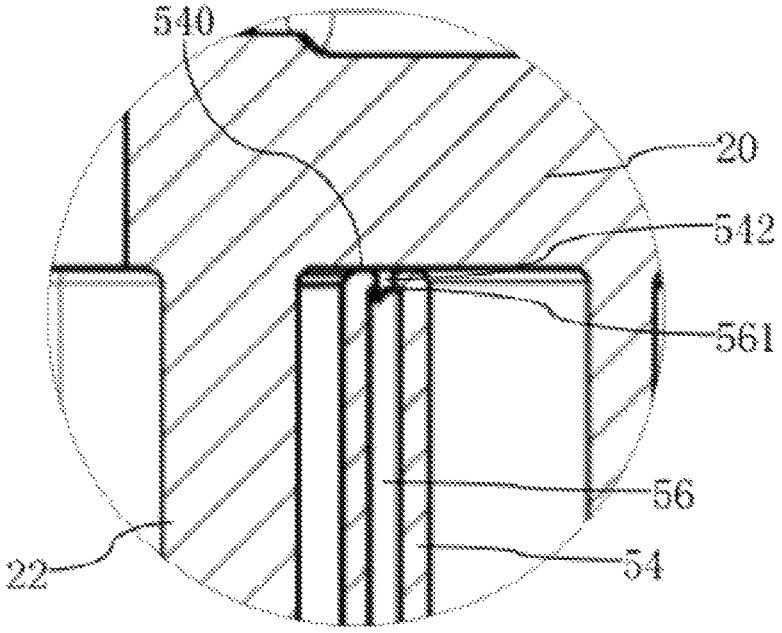
FIG. 9 shows a partial enlarged schematic drawing of the moving scroll of the compressor shown in FIG. 1 when at a first position relative to a static scroll.
Figure 10:
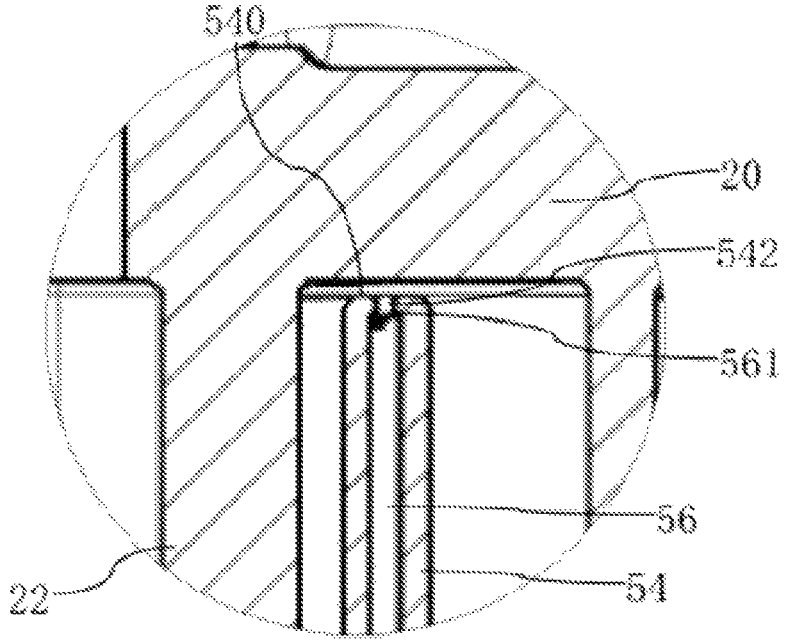
FIG. 10 shows a partial enlarged schematic drawing of the moving scroll of the compressor shown in FIG. 9 when at a second position relative to the static scroll.

The fluid in the compression chamber 11 and the fluid in the backpressure chamber 12 have dynamically changing pressure and separately apply pressure to the moving scroll 5 from opposite directions. As shown in FIG. 1, the fluid in the compression chamber 11 applies pressure to the moving scroll 5 downwards from above, whereas the fluid in the backpressure chamber 12 applies pressure to the moving scroll 5 upwards from below. The pressures in the two directions change dynamically, and when the magnitudes of the two pressures are equal, the action forces cancel each other out to achieve equilibrium, such that friction between the moving scroll 5 and the static scroll 2 is minimized. The moving scroll 5 is mounted with an axial clearance fit between the static scroll 2 and the middle plate 3. If the magnitudes of the two pressures in the compression chamber 11 and the backpressure chamber 12 are not balanced, the moving scroll 5 can move slightly between a first position and a second position in an axial direction, between the static scroll 2 and the middle plate 3. If the pressure from the compression chamber 11 is less than the pressure from the backpressure chamber 12, the moving scroll 5 is located at the first position, as shown in FIG. 9; the end face 540 is in tight contact with the static scroll 2, the collection groove 542 is isolated from the compression chamber 11, and high-pressure fluid in the compression chamber 11 is not able to enter the first port 561. If the pressure from the compression chamber 11 is greater than the pressure from the back-pressure chamber 12, the moving scroll 5 moves downwards to be located at the second position, as shown in FIG. 10; the end face 540 leaves the static scroll 2, the collection groove 542 is connected to the compression chamber 11, and high-pressure fluid in the compression chamber 11 enters the first port 561 through the collection groove 542, entering and replenishing the backpressure chamber 12 via the channel 56 and the second port 562. At this time, the fluid in the backpressure chamber 12 is replenished and increases in pressure; if the pressure from the backpressure chamber 12 is greater than the pressure from the compression chamber 11, the moving scroll 5 moves upwards and returns to the first position. This cycle is repeated. Clearly, on the one hand, it is necessary to prevent a situation where the pressure from the compression chamber 11 is excessively lower than the pressure from the backpressure chamber 12, so as to prevent an excessively large friction loss; on the other hand, it is necessary to prevent a situation where the pressure from the compression chamber 11 is excessively greater than the pressure from the backpressure chamber 12, so as to prevent an excessively large leakage loss. Thus, achieving a suitable balance between the pressure from the compression chamber 11 and the pressure from the backpressure chamber 12 helps to improve the compression efficiency of the compressor 100.

If the span of extension of the collection groove 542 of the present application is large, high-pressure fluid from the compression chamber 11 can be collected over a larger range, making it easier to collect high-pressure fluid. In some particular embodiments, from the first port 561 to the collection end 544, the collection groove 542 extends not less than 60 degrees and not more than 400 degrees around the axis X'. For example, from the first port 561 to the collection end 544, the collection groove 542 extends 60 degrees, 90 degrees, 110 degrees, 180 degrees, 220 degrees, 260 degrees, 300 degrees, 365 degrees or 400 degrees around the axis X'. In some particular embodiments, the outer diameter of the moving scroll 5 is not greater than 120 mm. For example, the outer diameter of the moving scroll 5 is 100 mm. From the first port 561 to the collection end 544, the length of extension of the collection groove 542 around the axis X' is not less than 15 mm. For example, from the first port 561 to the collection end 544, the length of extension of the collection groove 542 around the axis X' is 20 mm, 30 mm, 36 mm, 40 mm, 60 mm, 80 mm, 100 mm or 150 mm.

If the span of extension of the collection groove 542 is large, there is no need to make the collection groove 542 very wide and thereby remove an excessive amount of the area of the end face 540 of the moving scroll wall 54. Because the width of the collection groove 542 is smaller, the strength of the moving scroll wall 54 is impaired to a lesser extent, and it is easier to ensure that effective sliding contact between the end face 540 of the moving scroll wall 54 and the static base plate 20 is impaired to only a very small degree, so the compression efficiency is increased by reducing leakage. In some particular embodiments, the width of the collection groove 542 is not more than 0.9 times the thickness of the moving scroll wall 54. For example, the width of the collection groove 542 is 0.3 times, 0.4 times, 0.5 times, 0.6 times, 0.7 times or 0.8 times the thickness of the moving scroll wall 54. The width of the collection groove 542 is not greater than 3 mm. The depth of the collection groove 542 is greater than 0.2 mm and less than 3 mm. For example, the depth of the collection groove 542 is 0.3 mm, 0.4 mm, 0.45 mm, 0.5 mm, 0.55 mm, 0.68 mm, 1.75 mm or 2.8 mm. In some particular embodiments, the collection end 544 is processed into a circular shape, and the diameter of the collection end 544 is greater than the width of the collection groove 542. The collection end 544 that is enlarged relative to the collection groove 542 maximizes the collection of fluid in the compression chamber 11 at the position where the pressure is generally highest.

Figure 2:
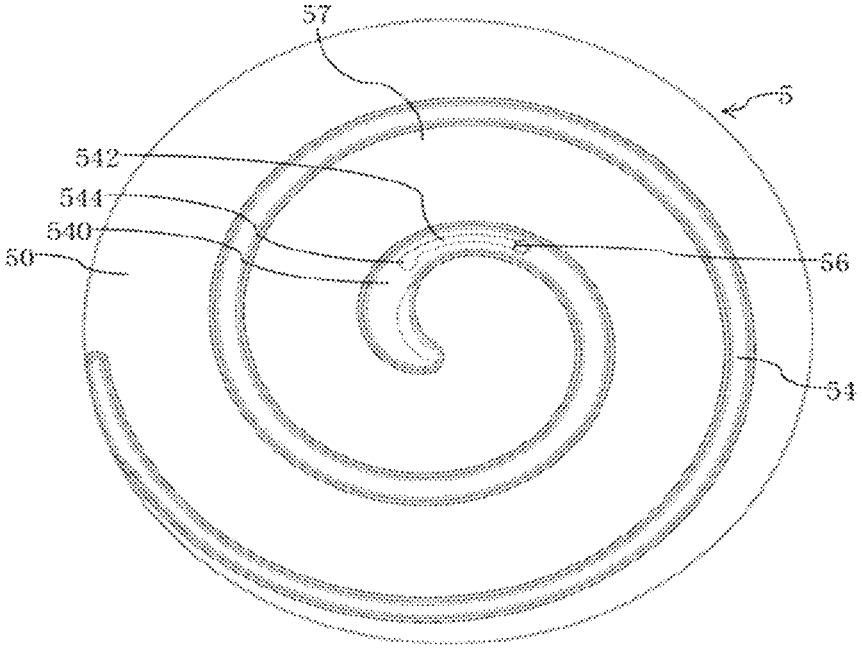
FIG. 2 shows a schematic drawing of a moving scroll of a compressor in a particular embodiment, in which the collection groove is shorter.
Figure 3:
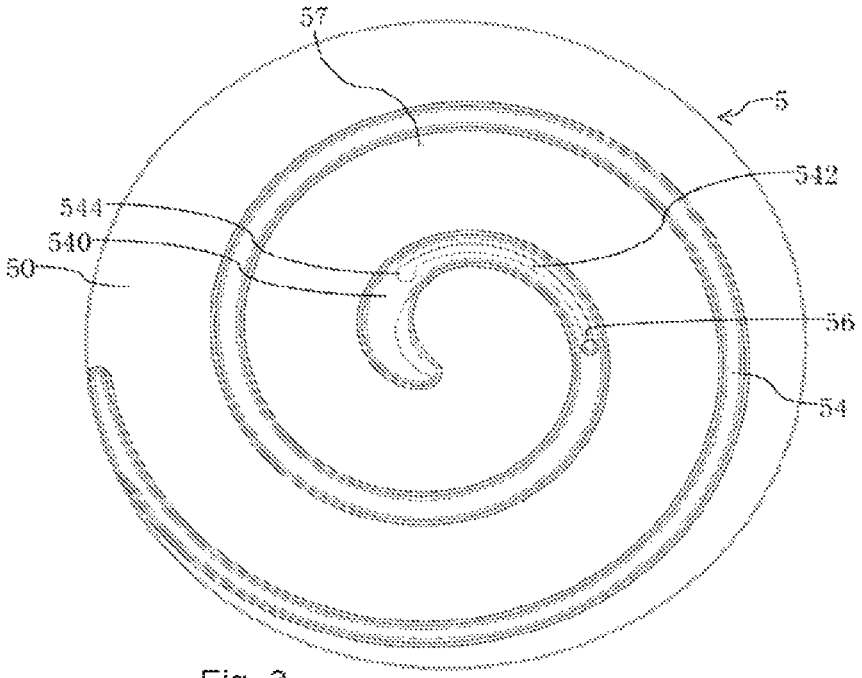
FIG. 3 shows a schematic drawing of a moving scroll of a compressor in another particular embodiment, in which the collection groove is longer.

Refer to FIGS. 2 and 3, in which the circular profile of the channel 56 is shown with a dotted line, the diameter of the channel 56 being greater than the width of the collection groove 542. In some particular embodiments, the diameter of the channel 56 is not less than 0.2 times the thickness of the moving scroll wall 54 and not more than 0.9 times the thickness of the moving scroll wall 54. For example, the diameter of the channel 56 is 0.3 times, 0.45 times, 0.5 times, 0.6 times, 0.7 times or 0.8 times the thickness of the moving scroll wall 54.

Figure 4:
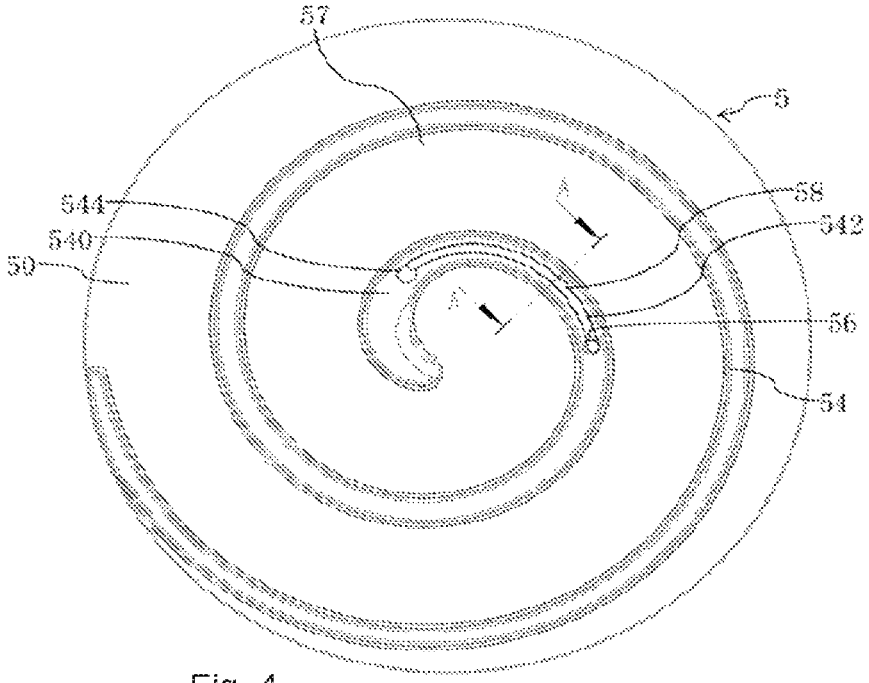
FIG. 4 shows a schematic drawing of a moving scroll of a compressor in another particular embodiment, in which a sealing member is installed on the collection groove.
Figure 5:
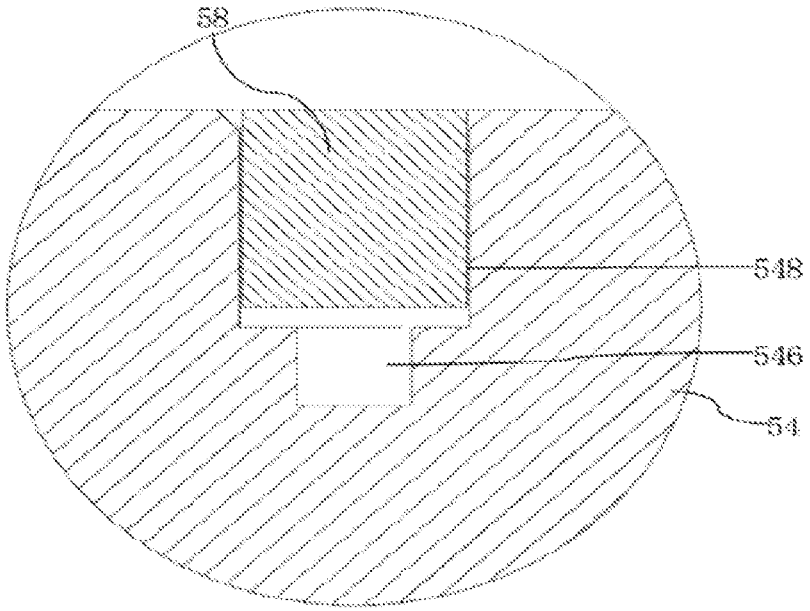
FIG. 5 shows a partial enlarged schematic drawing of a section taken along line A-A shown in FIG. 4.

Referring to FIGS. 4 and 5, in some particular embodiments, the collection groove 542 comprises a bottom groove 546 and a sealing part 548. The bottom groove 546 is closer to the moving base plate 50 than the sealing part 548. The width of the bottom groove 546 is not more than 0.3 times the thickness of the moving scroll wall 54. The width of the sealing part 548 is greater than that of the bottom groove 546, such that a step is formed between the sealing part 548 and the bottom groove 546, and a sealing member 58 is installed in the sealing part 548. The sealing member 58 is supported on the step. The sealing member 58 extends towards the collection end 544 from above the first port 561 but does not seal the collection end 544. The sealing member 58 prevents fluid from entering the bottom groove 546 and the channel 56 in the direction of the axis X'. The sealing member 58 has a certain length in the circumferential direction of the moving scroll 5. For example, the length of the sealing member 58 is 0.3 times, 0.35 times, 0.4 times, 0.5 times, 0.6 times, 0.65 times, 0.75 times, 0.85 times or 0.98 times the total length of the collection groove 542. As stated above, in general, the pressure of fluid in the compression chamber gradually increases from the periphery towards the center, i.e. the pressure is different at different positions. With other conditions unchanged, the position where fluid is collected can be conveniently changed by selecting sealing parts 548 of different lengths, and it is thus possible to change the pressure range of fluid collected from the collection groove 542 and the collection end 544. A suitable fluid pressure for replenishment of the backpressure chamber 12 from the compression chamber 11 is thus conveniently achieved. It is very easy to achieve a suitable balance between the pressure from the compression chamber 11 and the pressure from the backpressure chamber 12, so that the compressor 100 achieves good compression efficiency.

Figure 6:
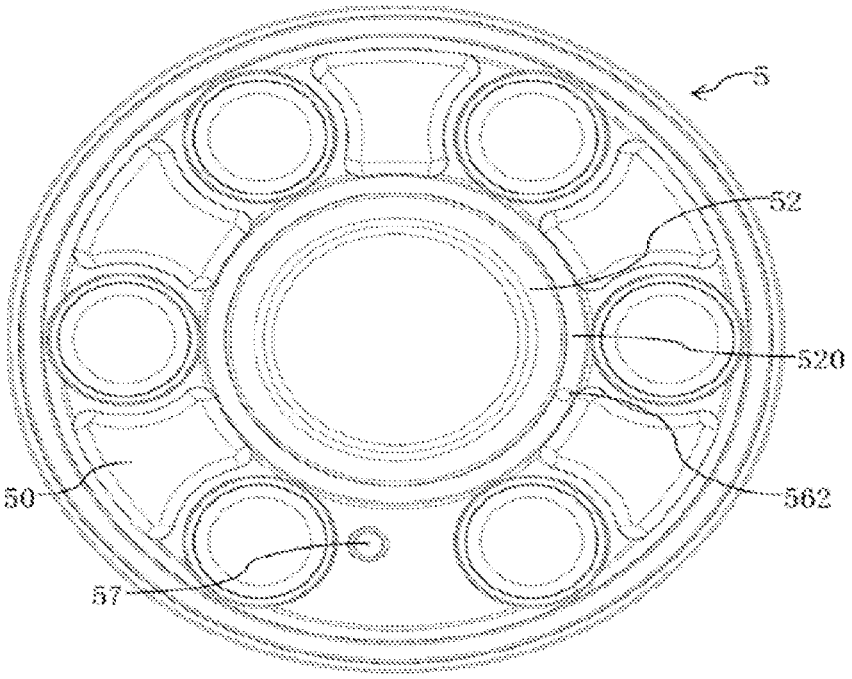
FIG. 6 shows a schematic drawing of a second port in a particular embodiment of a pressurization channel of a moving scroll.
Figure 7:
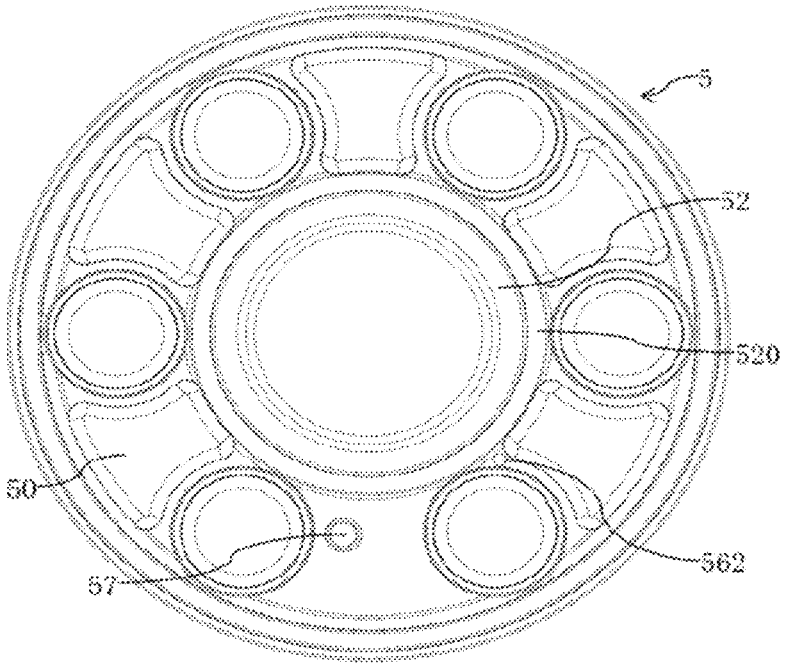
FIG. 7 shows a schematic drawing of a second port in another particular embodiment of a pressurization channel of a moving scroll.
Figure 8:
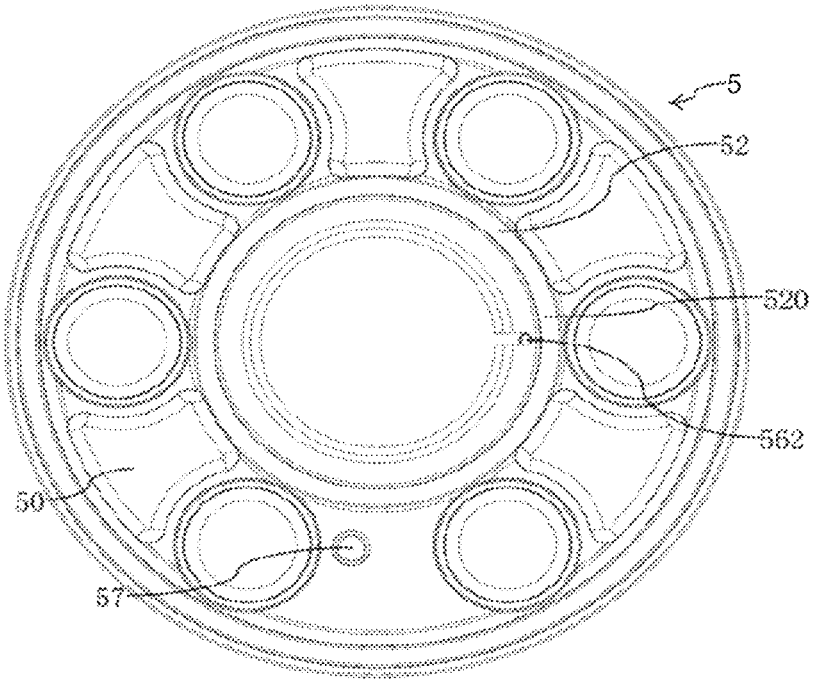
FIG. 8 shows a schematic drawing of a second port in another particular embodiment of a pressurization channel of a moving scroll.

The position of the second port 562 may be realized in various ways. Referring to FIG. 6, in some particular embodiments, the second port 562 is located at a surface at one end, in the direction of the axis X', of a peripheral wall 520 of the shaft seat 52, i.e. the second port 562 is located at a lower surface of the peripheral wall 520 of the shaft seat 52. Referring to FIG. 7, the second port 562 is located at a relatively protruding region at an outer side of the peripheral wall 520 of the shaft seat 52. Referring to FIG. 8, the second port 562 is located in the shaft seat 52. Some of these particular embodiments make it easier for a drilling tool to cut in, while others make it easier to lubricate components such as bearings with lubricating oil in the fluid that flows in through the second port 562.

In some particular embodiments, a throttle hole 57 running in the direction of the axis X' is disposed between the first side 501 and the second side 502, the radial distance from the throttle hole 57 to the axis X' being not less than 0.3 times the radius of the moving scroll 5. If the pressure in the backpressure chamber 12 is too high, high-pressure fluid in the backpressure chamber 12 can be flowed back to the compression chamber 11 at a more peripheral, lower-pressure position by means of the throttle hole 57, to suitably lower the high pressure in the backpressure chamber 12. The diameter of the throttle hole 57 is less than 0.3 times the diameter of the channel 56. By flowing the high-pressure fluid in the backpressure chamber 12 back slowly, excessively fast leakage of fluid in the backpressure chamber 12 is prevented. Thus, high compression working efficiency is maintained.

Notwithstanding the explanation above, the scope of patent protection of the present application is defined by the claims.

KEY TO THE FIGURES compressor 100
housing 1
accommodating cavity 10
compression chamber 11
backpressure chamber 12
suction chamber 14
static scroll 2
static base plate 20
static scroll wall 22
discharge port 28
middle plate 3
main shaft 40
eccentric shaft 42
main bearing 46
moving scroll 5
moving base plate 50
first side 501
second side 502
shaft seat 52
peripheral wall 520
moving scroll wall 54
end face 540
collection groove 542
collection end 544
bottom groove 546
sealing part 548
channel 56
first port 561
second port 562
throttle hole 57
sealing member 58
main axis X
axis X'

The invention claimed is:

1. A moving scroll comprising:

a moving base plate (50), provided with a shaft seat (52) with an axis as its shaft center, the moving base plate (50) comprising a first side (501) and a second side (502) which are opposite each other in a direction of the axis, the shaft seat (52) being disposed at the second side (502);

a moving scroll wall (54), integrally formed at the first side (501) of the moving base plate (50), the moving scroll wall (54) extending around the axis from a position near the axis in a direction away from the axis, the moving scroll wall (54) having an end face (540), the end face (540) being located at the end of the moving scroll wall (54) that is opposite the moving base plate (50) in the direction of the axis, and a collection groove (542) being disposed on the end face (540);

a channel (56) running in the direction of the axis is disposed between the collection groove (542) and the second side (502), the channel (56) and the collection groove (542) being connected at a first port (561), the channel (56) running through the second side (502) at a second port (562), the collection groove (542) extending from the first port (561) to a collection end (544) in a direction towards the center of the moving scroll, and the collection groove (542) extending not less than 60 degrees and not more than 400 degrees around the axis from the first port (561) to the collection end (544);

wherein the collection groove (542) terminates at the first port (561).

2. The moving scroll according to claim 1, wherein a diameter of the channel (56) is not less than 0.2 times a thickness of the moving scroll wall (54) and not more than 0.9 times the thickness of the moving scroll wall (54), a width of the collection groove (542) is not more than 0.9 times the thickness of the moving scroll wall (54), and the collection groove (542) extends not less than 90 degrees and not more than 365 degrees around the axis from the first port (561) to the collection end (544).

3. The moving scroll according to claim 1, wherein a diameter of the channel (56) is not less than 0.3 times a thickness of the moving scroll wall (54) and not more than 0.7 times the thickness of the moving scroll wall (54), the collection groove (542) comprises a bottom groove (546) and a sealing part (548), the bottom groove (546) being closer to the moving base plate (50) than the sealing part (548), a width of the bottom groove (546) being not more than 0.3 times the thickness of the moving scroll wall (54), a width of the sealing part (548) being greater than the width of the bottom groove (546), and a sealing member (58) is installed in the sealing part (548), the sealing member (58) extending towards the collection end (544) from above the first port (561) but not sealing the collection end (544), the sealing member (58) preventing fluid from entering the bottom groove (546) and the channel (56) in the direction of the axis, and a length of the sealing member (58) in a circumferential direction of the moving scroll (5) being not less than 0.3 times a total length of the collection groove (542).

4. The moving scroll according to claim 3, wherein the width of the sealing part (548) is greater than the width of the bottom groove (546) such that a step is formed between the sealing part (548) and the bottom groove (546), the sealing member (58) is supported on the step, the collection groove (542) extends not less than 110 degrees and not more than 300 degrees around the axis from the first port (561) to the collection end (544), and the length of the sealing member (58) in the circumferential direction of the moving scroll (5) is not less than 0.6 times the total length of the collection groove (542).

5. The moving scroll according to claim 1, wherein a length of extension of the collection groove (542) around the axis from the first port (561) to the collection end (544) is not less than 15 mm, and an outer diameter of the moving scroll (5) is not greater than 120 mm.

6. The moving scroll according to claim 1, wherein the second port (562) is located at a surface at one end, in the direction of the axis, of a peripheral wall (520) of the shaft seat (52), or located at a relatively protruding region at an outer side of the peripheral wall (520) of the shaft seat (52), a throttle hole (57) running in the direction of the axis is disposed between the first side (501) and the second side (502), a radial distance from the throttle hole (57) to the axis being not less than 0.3 times a radius of the moving scroll (5), and a diameter of the throttle hole (57) being less than 0.3 times a diameter of the channel (56).

7. The moving scroll according to claim 1, wherein the collection end (544) is configured in a circular shape, a diameter of the collection end (544) is greater than a width of the collection groove (542), the width of the collection groove (542) is not greater than 3 mm, and a depth of the collection groove (542) is greater than 0.2 mm and less than 3 mm.

8. A compressor comprising:

a housing (1), defining an accommodating cavity (10);

a static scroll (2) fixed in the accommodating cavity (10), the static scroll (2) comprising a static base plate and a static scroll wall, the static base plate and the static scroll wall being integrally formed;

a middle plate (3), the middle plate (3) being fixed in the accommodating cavity (10);

a main shaft (40), rotatable relative to the housing (1) around a main axis, the main shaft (40) being provided with an eccentric shaft (42);

a moving scroll comprising a moving base plate (50), provided with a shaft seat (52) with an axis as its shaft center, the moving base plate (50) comprising a first side (501) and a second side (502) which are opposite each other in a direction of the axis, the shaft seat (52) being disposed at the second side (502);

a moving scroll wall (54), integrally formed at the first side (501) of the moving base plate (50), the moving scroll wall (54) extending around the axis from a position near the axis in a direction away from the axis, the moving scroll wall (54) having an end face (540), the end face (540) being located at an end of the moving scroll wall (54) that is opposite the moving base plate (50) in the direction of the axis, and a collection groove (542) being disposed on the end face (540);

a channel (56) running in the direction of the axis is disposed between the collection groove (542) and the second side (502), the channel (56) and the collection groove (542) being connected at a first port (561), the channel (56) running through the second side (502) at a second port (562), the collection groove (542) extending from the first port (561) to a collection end (544) in a direction towards the center of the moving scroll, and the collection groove (542) extending not less than 60 degrees and not more than 400 degrees around the axis from the first port (561) to the collection end (544);

the moving scroll (5) being mounted between the static scroll (2) and the middle plate (3), the eccentric shaft (42) being mounted in the shaft seat (52), a shaft center of the eccentric shaft (42) coinciding with the axis, the axis being located on a parallel line offset from the main axis, a side face of the moving scroll wall (54) meshing with a side face of the static scroll wall, the end face (540) of the moving scroll wall (54) being in sliding contact with the static base plate, a compression chamber (11) being formed between the moving scroll (5) and the static scroll (2), a backpressure chamber (12) being formed between the middle plate (3) and the second side (502), and the second port (562) being located in the backpressure chamber (12);

wherein the moving scroll (5) is movable between a first position and a second position in an axial direction, between the static scroll (2) and the middle plate (3); at the first position, the end face (540) is in tight contact with the static scroll (2); at the second position, the end face (540) leaves the static scroll (2); at the first position, the collection groove (542) is isolated from the compression chamber (11); and at the second position, the collection groove (542) is connected to the compression chamber (11).

9. The compressor according to claim 8, wherein a suction chamber (14) is formed between the housing (1) and the side of the middle plate (3) that is opposite the backpressure chamber (12), a main bearing (46) is mounted on the middle plate (3), the main bearing (46) supports the main shaft (40), a rolling bearing is mounted in the shaft seat (52), and the second port (562) is located in the shaft seat (52).

10. The compressor according to claim 8, wherein a diameter of the channel (56) is not less than 0.2 times a thickness of the moving scroll wall (54) and not more than 0.9 times the thickness of the moving scroll wall (54), a width of the collection groove (542) is not more than 0.9 times the thickness of the moving scroll wall (54), and the collection groove (542) extends not less than 90 degrees and not more than 365 degrees around the axis from the first port (561) to the collection end (544).

11. The compressor according to claim 8, wherein a diameter of the channel (56) is not less than 0.3 times a thickness of the moving scroll wall (54) and not more than 0.7 times the thickness of the moving scroll wall (54), the collection groove (542) comprises a bottom groove (546) and a sealing part (548), the bottom groove (546) being closer to the moving base plate (50) than the sealing part (548), a width of the bottom groove (546) being not more than 0.3 times the thickness of the moving scroll wall (54), a width of the sealing part (548) being greater than the width of the bottom groove (546), and a sealing member (58) is installed in the sealing part (548), the sealing member (58) extending towards the collection end (544) from above the first port (561) but not sealing the collection end (544), the sealing member (58) preventing fluid from entering the bottom groove (546) and the channel (56) in the direction of the axis, and a length of the sealing member (58) in a circumferential direction of the moving scroll (5) being not less than 0.3 times a total length of the collection groove (542).

12. The compressor according to claim 11, wherein the width of the sealing part (548) is greater than the width of the bottom groove (546) such that a step is formed between the sealing part (548) and the bottom groove (546), the sealing member (58) is supported on the step, the collection groove (542) extends not less than 110 degrees and not more than 300 degrees around the axis from the first port (561) to the collection end (544), and the length of the sealing member (58) in the circumferential direction of the moving scroll (5) is not less than 0.6 times the total length of the collection groove (542).

13. The compressor according to claim 8, wherein a length of extension of the collection groove (542) around the axis from the first port (561) to the collection end (544) is not less than 15 mm, and an outer diameter of the moving scroll (5) is not greater than 120 mm.

14. The compressor according to claim 8, wherein the second port (562) is located at a surface at one end, in the direction of the axis, of a peripheral wall (520) of the shaft seat (52), or located at a relatively protruding region at an outer side of the peripheral wall (520) of the shaft seat (52), a throttle hole (57) running in the direction of the axis is disposed between the first side (501) and the second side (502), a radial distance from the throttle hole (57) to the axis being not less than 0.3 times a radius of the moving scroll (5), and a diameter of the throttle hole (57) being less than 0.3 times a diameter of the channel (56).

15. The compressor according to claim 8, wherein the collection end (544) is configured in a circular shape, a diameter of the collection end (544) is greater than a width of the collection groove (542), the width of the collection groove (542) is not greater than 3 mm, and a depth of the collection groove (542) is greater than 0.2 mm and less than 3 mm.

16. A moving scroll comprising:

a moving base plate (50), provided with a shaft seat (52) with an axis as its shaft center, the moving base plate (50) comprising a first side (501) and a second side (502) which are opposite each other in a direction of the axis, the shaft seat (52) being disposed at the second side (502);

a moving scroll wall (54), integrally formed at the first side (501) of the moving base plate (50), the moving scroll wall (54) extending around the axis from a position near the axis in a direction away from the axis, the moving scroll wall (54) having an end face (540), the end face (540) being located at the end of the moving scroll wall (54) that is opposite the moving base plate (50) in the direction of the axis, and a collection groove (542) being disposed on the end face (540);

a channel (56) running in the direction of the axis is disposed between the collection groove (542) and the second side (502), the channel (56) and the collection groove (542) being connected at a first port (561), the channel (56) running through the second side (502) at a second port (562), the collection groove (542) extending from the first port (561) to a collection end (544) in a direction towards the center of the moving scroll, and the collection groove (542) extending not less than 60 degrees and not more than 400 degrees around the axis from the first port (561) to the collection end (544);

wherein a diameter of the channel (56) is not less than 0.3 times a thickness of the moving scroll wall (54) and not more than 0.7 times the thickness of the moving scroll wall (54), the collection groove (542) comprises a bottom groove (546) and a sealing part (548), the bottom groove (546) being closer to the moving base plate (50) than the sealing part (548), a width of the bottom groove (546) being not more than 0.3 times the thickness of the moving scroll wall (54), a width of the sealing part (548) being greater than the width of the bottom groove (546), and a sealing member (58) is installed in the sealing part (548), the sealing member (58) extending towards the collection end (544) from above the first port (561) but not sealing the collection end (544), the sealing member (58) preventing fluid from entering the bottom groove (546) and the channel (56) in the direction of the axis, and a length of the sealing member (58) in a circumferential direction of the moving scroll (5) being not less than 0.3 times a total length of the collection groove (542).

17. The moving scroll according to claim 10, wherein the width of the sealing part (548) is greater than the width of the bottom groove (546) such that a step is formed between the sealing part (548) and the bottom groove (546), the sealing member (58) is supported on the step, the collection groove (542) extends not less than 110 degrees and not more than 300 degrees around the axis from the first port (561) to the collection end (544), and the length of the sealing member (58) in the circumferential direction of the moving scroll (5) is not less than 0.6 times the total length of the collection groove (542).

* * * * *